US006890418B2

(12) United States Patent
Bulan et al.

(10) Patent No.: US 6,890,418 B2
(45) Date of Patent: May 10, 2005

(54) PROCESS FOR THE ELECTROLYSIS OF AN AQUEOUS SOLUTION OF ALKALI METAL CHLORIDE

(75) Inventors: Andreas Bulan, Langenfeld (DE); Fritz Gestermann, Leverkusen (DE); Hans-Dieter Pinter, Wermelskirchen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 77 days.

(21) Appl. No.: 10/308,736

(22) Filed: Dec. 3, 2002

(65) Prior Publication Data

US 2003/0121795 A1 Jul. 3, 2003

(30) Foreign Application Priority Data

Dec. 5, 2001 (DE) ..... 101 59 708

(51) Int. Cl.[7] ..... C25B 1/46
(52) U.S. Cl. ..... 205/516; 205/537
(58) Field of Search ..... 205/620, 621, 205/618, 510, 516, 537

(56) References Cited

U.S. PATENT DOCUMENTS 4,240,883 A 12/1980 Iijima et al.
4,295,944 A 10/1981 Satoh et al.
4,586,994 A * 5/1986 Samejima et al. ..... 205/537
6,488,833 B1 * 12/2002 Sakata et al. ..... 205/516

FOREIGN PATENT DOCUMENTS

| | | | |
|---|---|---|---|
| EP | A 1 067 215 | 1/2001 | |
| EP | 1120481 | 8/2001 | |
| JP | 2001-003188 A * | 1/2001 | ..... C25B/9/00 |

* cited by examiner

*Primary Examiner*—Roy King
*Assistant Examiner*—Harry Wilkins, III
(74) *Attorney, Agent, or Firm*—Connolly Bove Lodge & Hutz LLP

(57) ABSTRACT

The invention describes a process for the electrolysis of an aqueous solution of alkali metal chloride, in particular sodium chloride, by the membrane process with an aqueous solution of alkali metal hydroxide, in particular sodium hydroxide, as catholyte, where the temperature of the alkali metal chloride solution in the anode half-element and/or the volume flow rate of the alkali metal chloride solution in the anode half-element are set in such a way that the difference between the temperature of the alkali metal hydroxide solution at the entry into the cathode half-element and the temperature of the alkali metal hydroxide solution at the exit from the cathode half-element are not greater than 15° C.

6 Claims, No Drawings

PROCESS FOR THE ELECTROLYSIS OF AN AQUEOUS SOLUTION OF ALKALI METAL CHLORIDE

The invention relates to a process for the electrolysis of an aqueous alkali metal chloride solution.

The preparation of chlorine and aqueous alkali metal hydroxide solution, for example sodium hydroxide solution (also referred to below as caustic soda solution), by electrolysis of an alkali metal chloride solution, for example sodium chloride solution, by means of gas diffusion electrodes as oxygen-consuming cathodes is known. The electrolysis cell here is composed of an anode half-element and a cathode half-element, which are separated by a cation exchanger membrane. The cathode half-element consists of an electrolyte space, which is separated from a gas space by a gas diffusion electrode. The electrolyte space is filled with alkali metal hydroxide solution. The gas space is supplied with oxygen, air or oxygen-enriched air. An alkali metal chloride-containing solution is located in the anode half-element.

EP-A 1 067 215 discloses a process for the electrolysis of an aqueous solution of alkali metal chloride using a gas diffusion electrode as oxygen-consuming cathode, in which the flow rate of the alkali metal hydroxide solution in the electrolyte space of the cathode half-cell is at least 1 cm/s. According to EP-A 1 067 215, the high flow rate of the alkali metal hydroxide solution causes good mixing and thus homogenization of the alkali metal hydroxide concentration in the electrolyte space. In the case of alkali metal chloride electrolysis without a gas diffusion electrode as oxygen-consuming cathode, by contrast, high flow rates are unnecessary since the hydrogen formed at the cathode in electrolysis operation ensures adequate mixing of the alkali metal hydroxide solution.

A disadvantage of the process disclosed in EP-A 1 067 215 is that the current yield decreases with increasing flow rates of the alkali metal hydroxide solution. On the other hand, the temperature of the alkali metal hydroxide solution in the cathode half-element increases to a greater extent with decreasing flow rate.

The object of the present invention is therefore to provide a process for the electrolysis of aqueous solutions of alkali metal chloride which is simple to carry out and works with the lowest possible flow rates without adversely affecting the functioning of the electrolysis cell or of the electrolyser, in particular due to excessive temperatures of the alkali metal hydroxide solution in the cathode half-element.

The object is achieved in accordance with the invention through the features of claim 1.

The invention accordingly relates to a process for the electrolysis of an aqueous solution of alkali metal chloride, in particular sodium chloride, by the membrane process with an aqueous solution of alkali metal hydroxide, in particular sodium hydroxide, as catholyte, where the temperature of the alkali metal chloride solution in the anode half-element and/or the volume flow rate of the alkali metal chloride solution in the anode half-element are set in such a way that the difference between the temperature of the alkali metal hydroxide solution at the entry into the cathode half-element and the temperature of the alkali metal hydroxide solution at the exit from the cathode half-element are not greater than 15° C.

Surprisingly, the temperature of the alkali metal hydroxide solution in the cathode half-element can successfully be regulated by the process according to the invention with the aid of the temperature of the alkali metal chloride solution in the anode half-element and, if an anolyte circuit, i.e. a circuit of the alkali metal chloride solution, is present, with the aid of the volume flow rate of the alkali metal chloride solution. One of the two measures or both measures together allow warming of the alkali metal hydroxide solution to be countered, in particular even at low flow rates of the alkali metal hydroxide solution of less than 1 cm/s. A temperature difference of greater than 15° C., preferably greater than 10° C., between the entry and exit of the alkali metal hydroxide solution is undesirable, inter alia since a strong gradient in the conductivity of the alkali metal hydroxide solution would be associated with a strong temperature gradient between entry and exit.

The alkali metal hydroxide solution in the cathode half-element can thus be cooled during the electrolysis process in such a way that the alkali metal hydroxide solution in the cathode half-element does not exceed the requisite temperature difference, either for a given volume flow rate and a given outflow temperature of the alkali metal chloride solution in the anode half-element with the aid of a low inflow temperature of the alkali metal chloride solution or for a given inflow temperature and given outflow temperature of the alkali metal chloride solution with the aid of a greater volume flow rate of the alkali metal chloride solution. The two measures can also be combined with one another. The volume flow rate of the alkali metal chloride solution is regulated by means of the amount of alkali metal chloride solution circulated by pumping.

An advantage of the process according to the invention is that the temperature of the alkali metal hydroxide solution does not have to be regulated by a high flow rate of at least 1 cm/s in the cathode half-element. Since the current yield drops with increasing flow rate, it is particularly advantageous to work at low flow rates of less than 1 cm/s.

Alternatively, the temperature of the alkali metal hydroxide solution can also be regulated with the aid of a heat exchanger installed upstream of the cathode half-element. However, this is unnecessary in the process according to the invention and saves the additional equipment complexity that would be caused by the installation of a heat exchanger.

In a preferred embodiment of the process according to the invention, the temperature of the alkali metal chloride solution on exiting from the anode half-element and the temperature of the alkali metal hydroxide solution on exiting from the cathode half-element are from 80° C. to 100° C., preferably from 85° C. to 95° C.

Preference is furthermore given to an embodiment in which the flow rate of the alkali metal hydroxide solution in the cathode half-element is less than 1 cm/s.

The process according to the invention is preferably carried out using a gas diffusion electrode as cathode. The alkali metal chloride solution as anolyte and the alkali metal hydroxide solution as catholyte are derived from the same alkali metal, for example sodium or potassium. The alkali metal chloride solution is preferably a sodium chloride solution and the alkali metal hydroxide solution is preferably a sodium hydroxide solution.

The volume flow rate of the alkali metal chloride solution in the anode half-element is dependent on the current density at which the electrolyser is operated. At a current density of 2.5 $kA/m^2$, the volume flow rate per element should be from 0.02 to 0.1 $m^3/h$. At a current density of 4 $kA/m^2$, the volume flow rate is from 0.11 to 0.25 $m^3/h$.

The process according to the invention can be operated at current densities in the range from 2 to 8 $kA/m^2$.

EXAMPLES

The electrolysis of an aqueous alkali metal chloride solution in accordance with the examples described below was carried out using an electrolyser consisting of 15 electrolysis cells. The cathodes used in the respective electrolysis cells were gas diffusion electrodes, with the separation from the gas diffusion electrode to the ion exchanger membrane being 3 mm and the length of the gap between ion exchanger membrane and gas diffusion electrode being 206 cm. The anodes employed were titanium anodes coated with ruthenium iridium oxides. The surface area of the anodes was 2.5 $m^2$. The ion exchanger membrane used was a Nafion® NX 981 from DuPont. The concentration of the sodium chloride solution (NaCl) on exiting from the anode half-element was 210 g/l. The concentration of the caustic soda solution (NaOH) in the cathode half-element was between 30 and 33% by weight. Unless explicitly stated in the following examples, the current density was 2.45 $kA/m^2$ and the volume flow rate of the caustic soda solution was 3 $m^3/h$. The latter corresponds to a caustic soda solution velocity in the gap between ion exchanger membrane and gas diffusion electrode of 0.85 cm/s.

The results of the examples are summarized in Tables 1, 2 and 3.

Example 1

Under the abovementioned conditions, a volume flow rate of the sodium chloride solution in the anode half-element of 1.0 $m^3/h$ was selected. The temperature of the sodium chloride solution at the inflow was 50° C. and that at the outflow was 85° C. The temperature difference between inflow and outflow of an anode half-element was thus 35° C. The caustic soda solution was fed to the cathode half-element with a temperature of 80° C. and discharged again with a temperature of 85° C. The current yield was determined as 96.20%.

Example 2

Under the abovementioned conditions, a volume flow rate of the sodium chloride solution in the anode half-element of 1.1 $m^3/h$ was selected. The temperature of the sodium chloride solution at the inflow was 50° C. and that at the outflow was 86° C. The temperature difference between inflow and outflow of an anode half-element was thus 36° C. The caustic soda solution was fed to the cathode half-element with a temperature of 79° C. and discharged again with a temperature of 85° C. The current yield was determined as 96.09%.

Example 3

Under the abovementioned conditions, a volume flow rate of the sodium chloride solution in the anode half-element of 1.2 $m^3/h$ was selected. The temperature of the sodium chloride solution at the inflow was 51° C. and that at the outflow was 85° C. The temperature difference between inflow and outflow of an anode half-element was thus 34° C. The caustic soda solution was fed to the cathode half-element with a temperature of 76° C. and discharged again with a temperature of 83° C. The current yield was determined as 96.11%.

Example 4

Under the abovementioned conditions, a volume flow rate of the sodium chloride solution in the anode half-element of 1.3 $m^3/h$ was selected. The temperature of the sodium chloride solution at the inflow was 55° C. and that at the outflow was 86° C. The temperature difference between inflow and outflow of an anode half-element was thus 31° C. The caustic soda solution was fed to the cathode half-element with a temperature of 77° C. and discharged again with a temperature of 83° C. The current yield was determined as 95.63%.

Example 5

Comparative Example

Under the abovementioned conditions, a volume flow rate of the sodium chloride solution in the anode half-element of 1.3 $m^3/h$ was selected. The current density was 2.5 $kA/m^2$. The temperature of the sodium chloride solution at the inflow was 85° C. and that at the outflow was 86° C. The temperature difference between inflow and outflow of an anode half-element was thus 1° C. The volume flow rate of the caustic soda solution in the cathode half-element was 10.5 $m^3/h$, corresponding to a caustic soda solution velocity in the gap between ion exchanger membrane and gas diffusion electrode of 2.95 cm/s. The caustic soda solution was fed to the cathode half-element with a temperature of 80° C. and discharged again with a temperature of 86° C. The current yield was determined as 95.4%.

Example 6

The current density here was 4 $kA/m^2$. A volume flow rate of the sodium chloride solution in the anode half-element of 2.08 $m^3/h$ was selected. The temperature of the sodium chloride solution at the inflow was 77° C. and that at the outflow was 86° C. The temperature difference between inflow and outflow of an anode half-element was thus 9° C. The volume flow rate of the caustic soda solution in the cathode half-element was 3 $m^3/h$, corresponding to a caustic soda solution velocity in the gap between ion exchanger membrane and gas diffusion electrode of 0.85 cm/s. The caustic soda solution was fed to the cathode half-element with a temperature of 82° C. and discharged again with a temperature of 87° C. The current yield was determined as 96.1%. This shows that the process according to the invention can be operated with good current yields even at higher current densities.

TABLE 1

Measurement values in the anode half-element

| Example | Temperature of NaCl at inflow [° C.] | Temperature of NaCl at outflow [° C.] | Temperature difference of NaCl [° C.] | Volume flow rate of NaCl [$m^3/h$] |
|---|---|---|---|---|
| 1 | 50 | 85 | 35 | 1 |
| 2 | 50 | 86 | 36 | 1.1 |
| 3 | 51 | 85 | 34 | 1.2 |
| 4 | 55 | 86 | 31 | 1.3 |
| 5 | 85 | 86 | 1 | 1.3 |
| 6 | 77 | 86 | 9 | 2.08 |

TABLE 2

Measurement values in the cathode half-element

| Example | Temperature of NaOH at inflow [° C.] | Temperature of NaOH at outflow [° C.] | Temperature difference of NaOH [° C.] | Volume flow rate of NaOH [$m^3/h$] |
|---|---|---|---|---|
| 1 | 80 | 85 | 5 | 3 |
| 2 | 79 | 85 | 6 | 3 |
| 3 | 76 | 83 | 7 | 3 |

TABLE 2-continued

| Measurement values in the cathode half-element | | | | |
|---|---|---|---|---|
| Example | Temperature of NaOH at inflow [° C.] | Temperature of NaOH at outflow [° C.] | Temperature difference of NaOH [° C.] | Volume flow rate of NaOH [$m^3$/h] |
| 4 | 77 | 83 | 6 | 3 |
| 5 | 80 | 86 | 6 | 10.5 |
| 6 | 82 | 87 | 5 | 3 |

TABLE 3

| Current density and current yield | | |
|---|---|---|
| Example | Current density [kA/$m^{2]}$ | Current yield [%] |
| 1 | 2.45 | 96.20 |
| 2 | 2.45 | 96.09 |
| 3 | 2.45 | 96.11 |
| 4 | 2.45 | 95.63 |
| 5 | 2.5 | 95.40 |
| 6 | 4.0 | 96.10 |

What is claimed is:

1. Process for the electrolysis of an aqueous solution of alkali metal chloride by a membrane process with an aqueous solution of alkali metal hydroxide as a catholyte and said process employing a gas diffusion electrode, wherein the temperature of the alkali metal chloride solution in an anode half-element and/or the volume flow rate of the alkali metal chloride solution in the anode half-element are set in such a way that the difference between the temperature of the alkali metal hydroxide solution at entry into a cathode half-element and the temperature of the alkali metal hydroxide solution at an exit from the cathode half-element is not greater than 15° C., and wherein the linear flow rate of the alkali metal hydroxide solution in the cathode half-element is less than 1 cm/s.

2. Process according to claim 1, wherein the temperature of the alkali metal chloride solution on exiting from the anode half-element and the temperature of the alkali metal hydroxide solution on exiting from the cathode half-element are from 80° C. to 100° C.

3. Process according to claim 1, wherein the temperature of the alkali metal chloride solution on exiting from the anode half-element and the temperature of the alkali metal hydroxide solution on exiting from the cathode half-element are from 85° C. to 95° C.

4. A process according to claim 1, wherein said alkali metal chloride comprises sodium chloride.

5. A process according to claim 1, wherein said alkali metal hydroxide comprises sodium hydroxide.

6. A process according to claim 4, wherein said alkali metal hydroxide comprises sodium hydroxide.

* * * * *